US008381691B2

(12) United States Patent
Clarke

(10) Patent No.: US 8,381,691 B2
(45) Date of Patent: Feb. 26, 2013

(54) FUEL INJECTION SYSTEM

(75) Inventor: John M. Clarke, Woodsboro, MD (US)

(73) Assignee: Motiv Engines, LLC, Reno, NV (US)

( * ) Notice: Subject to any disclaimer, the term of this patent is extended or adjusted under 35 U.S.C. 154(b) by 458 days.

(21) Appl. No.: 12/611,340

(22) Filed: Nov. 3, 2009

(65) Prior Publication Data

US 2011/0100334 A1 May 5, 2011

(51) Int. Cl.
*F01B 7/12* (2006.01)

(52) U.S. Cl. ..... 123/51 R; 123/50 R; 123/42; 123/50 A; 123/50 B

(58) Field of Classification Search ..... 123/51 A, 123/51 B, 50 B, 50 A, 50 R, 52.3, 52.5, 52.2, 123/445, 42
See application file for complete search history.

(56) References Cited

U.S. PATENT DOCUMENTS 4,977,864 A * 12/1990 Grant ..... 123/50 B
5,456,219 A * 10/1995 Clarke ..... 123/42
5,623,894 A 4/1997 Clarke
6,223,727 B1 5/2001 Tahara et al.
6,802,457 B1 10/2004 Campion et al.

FOREIGN PATENT DOCUMENTS

WO WO 2009/061873 5/2009

OTHER PUBLICATIONS

International Search Report and Written Opinion dated Jan. 10, 2011, in corresponding Int'l. Appln. No. PCT/US2010/055114.

* cited by examiner

*Primary Examiner* — Noah Kamen
*Assistant Examiner* — Hung Q Nguyen
(74) *Attorney, Agent, or Firm* — William P. O'Sullivan; Sheehan Phinney Bass + Green PA

(57) ABSTRACT

An engine includes a first piston with surfaces that define a substantially cylindrical chamber inside the first piston and a passage into the substantially cylindrical chamber. One or more second pistons are arranged to reciprocate inside the substantially cylindrical chamber and to define, in cooperation with the substantially cylindrical chamber, a combustion chamber. A fuel injector extends at least partially through the passage in the first piston to inject fuel into the combustion chamber. The first piston is arranged to move in a reciprocating manner relative to the fuel injector.

27 Claims, 5 Drawing Sheets

FUEL INJECTION SYSTEM

FIELD OF THE INVENTION

This invention relates to fuel injection for an internal combustion engine.

BACKGROUND

In an internal combustion engine, fuel and an oxidizing agent, such as air, undergo combustion in a combustion chamber. The resulting expansion of high pressure and high temperature gases applies a force to a movable component of the engine, such as a piston causing it to move, thereby, resulting in mechanical energy.

Internal combustion engines are used in a wide variety of applications, including, for example, automobiles, motorcycles, ship propulsion and generation of electricity.

It is generally desirable for internal combustion engines to be compact and highly efficient.

SUMMARY OF THE INVENTION

This invention relates to fuel injection system for an internal combustion engine.

In one aspect, an engine includes a first piston (also referred to as a "low pressure piston") with surfaces that define a substantially cylindrical chamber therein and a passage into the substantially cylindrical chamber. One or more second pistons (also referred to as "high pressure pistons") are arranged to reciprocate inside the substantially cylindrical chamber and to define, in cooperation with the substantially cylindrical chamber, a combustion chamber. A fuel injector extends at least partially through the passage and is arranged to inject fuel into the combustion chamber. Moreover, the first piston is arranged to move in a reciprocating manner relative to the fuel injector.

In some implementations, the fuel injector is arranged to reciprocate inside the passage relative to the first piston as the first piston moves in the reciprocating manner.

Typical embodiments of the engine include an engine casing and the fuel injector is stationary relative to the engine casing while the engine is operating. In some of such embodiments, the first piston is arranged to reciprocate along a first axis relative to the engine casing and the one or more second pistons are arranged to reciprocate along a second axis relative to the first piston. In these instances, the second axis is perpendicular to the first axis.

In certain embodiments, the first piston comprises a nipple with surfaces that at least partially define the passage into the substantially cylindrical chamber. In some instances, the nipple has surfaces that define an annular recess to accommodate an annular sealing member. The annular recess typically is near a far end of the nipple.

Some embodiments include an annular sealing member arranged at least partially inside the annular recess to seal the combustion chamber. The annular sealing member can have has an internal bore with a cross-sectional profile that is tapered toward the combustion chamber. The annular sealing member can have an internal bore with a chevron-shaped cross-sectional profile.

The annular sealing member typically forms a slight interference fit against a sealing portion of the fuel injector.

In a typical implementation, the sealing portion of the fuel injector is coated with an agent to enhance the seal's durability. As an example, the agent can include molybdenum.

According to certain implementations, the fuel injector is arranged to inject fuel into the combustion chamber when the fuel injector is approximately mid-stroke between a position of maximum extension into the combustion chamber and a position of maximum withdrawal from the combustion chamber.

In some embodiments, the engine has two second pistons arranged opposing each other inside the substantially cylindrical chamber. In these embodiments, the combustion chamber includes a space between the two opposing second pistons.

According to some implementations, the first piston further includes one or more combustion chamber intake valves at a first side of the first piston, and one or more combustion chamber exhaust valves at a second side of the first piston, opposite the first side. The fuel injector is arranged to inject fuel into the combustion chamber from the first side of the first piston.

The engine can be, for example, a compact compression ignition engine. The engine can include an annular sealing member arranged to seal the combustion chamber around a portion of the fuel injector.

In another aspect, a compact compression ignition engine includes an engine casing; a first piston inside the engine casing with surfaces that define a substantially cylindrical chamber inside the first piston and a passage into the substantially cylindrical chamber; opposing second pistons arranged to reciprocate inside the substantially cylindrical chamber and to define, in cooperation with the substantially cylindrical chamber, a combustion chamber between the opposing second pistons; and a fuel injector stationary relative to the engine casing and extended at least partially through the passage in the first piston to inject fuel into the combustion chamber. The first piston is arranged to move in a reciprocating manner relative to engine casing and the fuel injector.

In some implementations, the first piston is arranged to reciprocate along a first axis relative to the engine casing; and the second pistons are arranged to reciprocate along a second axis relative to the first piston. The second axis is perpendicular to the first axis.

According to certain embodiments, the first piston has a nipple with surfaces that at least partially define the passage into the substantially cylindrical chamber. The nipple has surfaces that define an annular recess near a far end of the nipple to accommodate an annular sealing member. The annular recess is near a far end of the nipple and an annular sealing member is arranged at least partially inside the annular recess and adapted to seal the combustion chamber.

The terms "high pressure" and "low pressure" are used herein to describe "pistons." These terms are used for convenience only and should not be considered to be limiting unless otherwise indicated. Moreover, the terms "up" and "down" are used throughout this application to describe the motion of various parts. These and other relative terms are used for convenience only and also should not be considered to be limiting unless otherwise indicated.

In some implementations, one or more of the following advantages are present.

For example, compact, highly efficient engines may be produced. The engines may be four to six times smaller than conventional engines of comparable power. Additionally, the engines may be 22% to 32% more efficient than currently available diesel engines. Moreover, the engines experience very low levels of vibration when operating. Moreover, the engines have very low mono-nitrogen oxides (NOx) emissions.

The techniques disclosed herein include simple, reliable techniques for injecting fuel into such engines. More particularly, an injection scheme is disclosed that can safely and effectively inject fuel into a moving (i.e., reciprocating) combustion chamber.

Other features and advantages will be apparent from the description and drawings, and from the claims.

DETAILED DESCRIPTION

Figure 1:
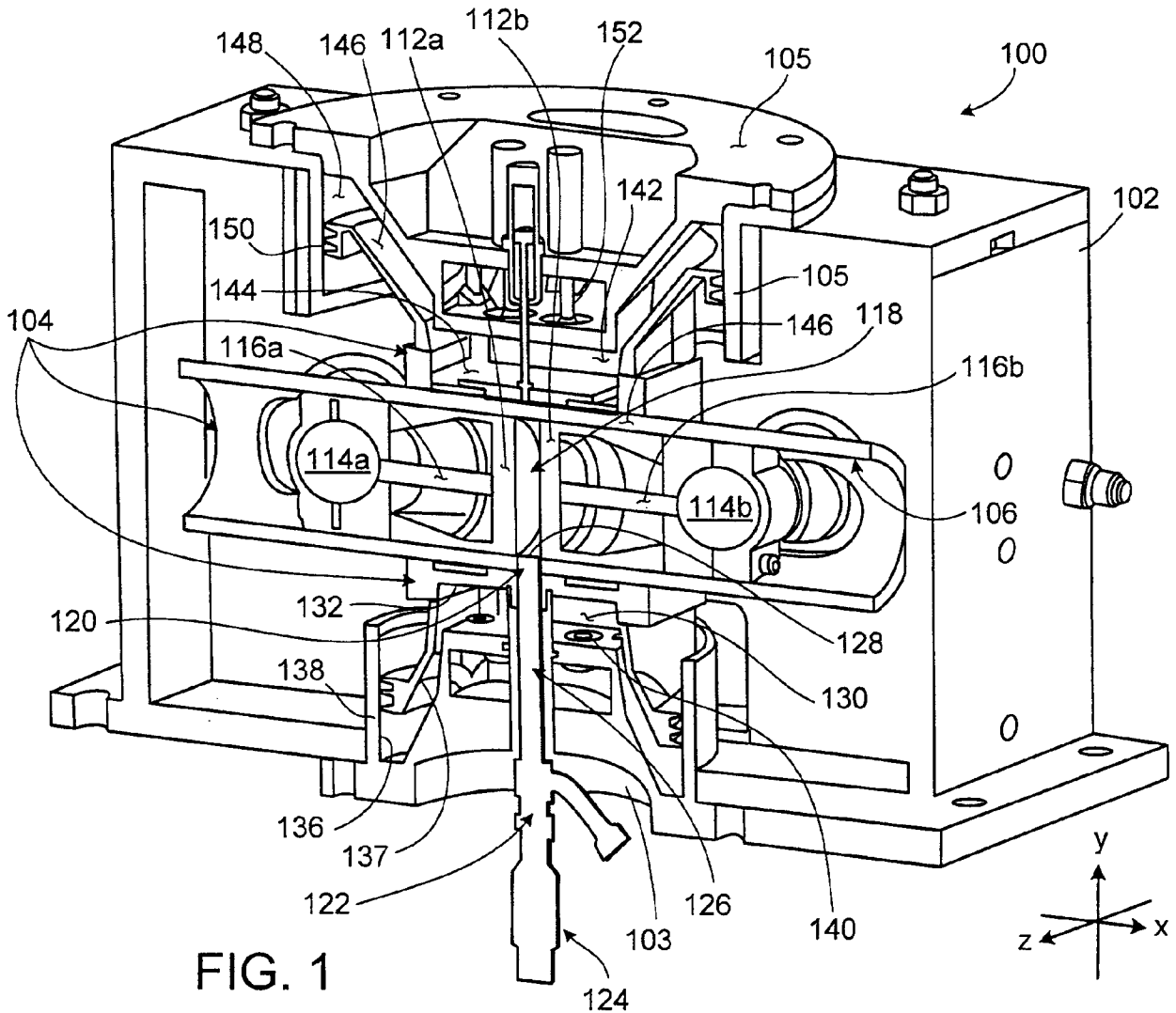
FIG. 1 is a cut-away perspective view of an engine.

FIG. 1 is a cut-away perspective view of an engine 100, such as a compact compression ignition engine.

The illustrated engine 100 includes an engine casing 102. An intake cylinder head 103 is coupled to a lower portion of the engine casing 102 and an exhaust cylinder head 105 is coupled to an upper portion of the engine casing 102.

A first piston (also referred to as a "low pressure piston") 104 is inside the engine casing 102 and is arranged to reciprocate relative to the engine casing 102 along axis y (i.e., vertically, in the illustrated implementation) when the engine is operating.

The low pressure piston assembly 104 has surfaces that define an internal, substantially cylindrical chamber 106 that extends along an axis that is perpendicular to the low pressure piston's axis of movement. More particularly, as shown, the chamber 106 extends horizontally, i.e., along the x-axis. In the illustrated implementation, the chamber 106 has substantially uniform dimensions along its entire length.

A pair of horizontally opposed second pistons (also referred to as "high pressure pistons") 112*a*, 112*b* are contained within the chamber 106.

Each high pressure piston 112*a*, 112*b* is arranged for reciprocal motion inside the chamber 106, along a horizontal axis (i.e., the x-axis) relative to the chamber 106 when the engine is operating. Each high pressure piston 112*a*, 112*b* is coupled to an associated crankshaft 114*a*, 114*b*. The movement of the high pressure pistons 112*a*, 112*b* about their respective crankshafts' axes of rotation causes the low pressure piston 104 to reciprocate in the vertical axis.

Each crankshaft 114*a*, 114*b* has main bearing journals that serve as points of support for the crankshaft and one or more journals that serve as points of connection for high pressure pistons. The crankshafts 114*a*, 114*b* rotate about their respective axes of rotation defined by their associated main bearing journals. The crankshafts 114*a*, 114*b* operate generally to translate the linear, reciprocal motion of each associated high pressure piston 112*a*, 112*b* inside the chamber 106 into rotational movement.

In the illustrated implementation, a high pressure piston oil cooling tube 116*a*, 116*b* extends through each high pressure piston as shown. Typically, oil for cooling is delivered through passages in the crankshafts 114*a*, 114*b* and through the high pressure piston oil cooling tubes 116*a*, 116*b* to cool the high pressure pistons.

In the illustrated figure, each high pressure piston 112*a*, 112*b* is positioned at approximately top dead center, that is, farthest from its crankshaft's axis of rotation. In a typical implementation, each high pressure piston 112*a*, 112*b* in a common chamber 106 reaches top dead center at substantially the same time. This arrangement helps balance the momentum of the high pressure pistons' individual momentums.

During operation, the high pressure pistons 112*a*, 112*b* reciprocate relative to the chamber 106 along an axis that is perpendicular to the low pressure piston's axis of movement. In the illustrated implementation, for example, the high pressure piston 112*a*, 112*b* reciprocate relative to chamber 106 along the x-axis, while the low pressure piston 104 reciprocates along the y-axis.

The engine's combustion chamber 118 is between the far ends of the high pressure pistons 112*a*, 112*b* inside chamber 106. When fuel combusts inside the combustion chamber 118, the high pressure pistons 112*a*, 112*b* are driven apart from one another by the force of the resulting explosion.

Since the combustion chamber 118 is inside the low pressure piston 104 and since the low pressure piston 104 reciprocates relative to the engine casing 102 when the engine is running, the combustion chamber 118 also reciprocates relative to the engine casing 102 when the engine is operating.

The low pressure piston 104 has surfaces that define a passage 120 (or opening) that extends through the low pressure piston 104 and into the combustion chamber 118. The passage 120 has an inner diameter that is sized to enable a portion of a fuel injector to extend through the passage 120 so that it can deliver fuel into the combustion chamber 118.

A fuel injector 122 is provided that includes a coupling portion 124 that can be coupled to a high pressure fuel delivery line (not shown in FIG. 1), a sliding portion 126 that extends from the coupling portion 124 and a fuel injection nozzle 128 at a far end of the sliding portion 126. The fuel injector has one or more internal passages that carry fuel from the high pressure fuel delivery line into the combustion chamber 118.

In a typical implementation, the sliding portion 126 of the fuel injector has a relatively smooth uniform outer surface that enables it to slide through the passage 120 in the low pressure piston 104 with relative ease. In some implementations, the outer surface of the sliding portion is substantially cylindrical and the passage 120 in the low pressure piston 104 is substantially cylindrical.

In the illustrated implementation, both the passage 120 into the combustion chamber 118 and the sliding portion 126 of the fuel injector 122 that extends through the passage 120 are substantially cylindrical in shape. Moreover, both the passage 120 into the combustion chamber 118 and the sliding portion 126 of the fuel injector 122 that extends through the passage 120 have substantially uniform dimensions along their entire lengths.

In the illustrated implementations, the fuel injector 122 is arranged so that its sliding portion 126 extends at least partially into the passage 120 in the low pressure piston 104. The sliding portion 126 is able to move in a reciprocating manner within the passage 120.

The fuel injector 122 is supported in such a manner that, when the engine 100 is operating, the fuel injector 122 remains substantially stationary relative to the engine casing 102. The illustrated fuel injector 122, for example, is directly coupled to the engine casing 102. It is generally desirable that the fuel injector 122 remain stationary relative to the engine casing 102 when the engine is operating, even though the combustion chamber 118 is moving relative to engine casing 102 because the high pressure fuel delivery lines (not shown in FIG. 1), which deliver fuel to the fuel injector 122 and which usually are quite rigid, can be coupled to the fuel injector 122 more securely if the fuel injector 122 remains stationary when the engine is operating.

Typically, an annular seal (not visible in FIG. 1) is provided in the passage 120 and seals against the sliding portion 126 of the fuel injector 122 to prevent combustion gases from undesirably exiting the combustion chamber 118 in the space between the sliding portion 126 of the fuel injector 122 and the surfaces of the passage 120 when the engine 100 is operating.

The fuel injector 122 is arranged so that when low pressure piston 104 moves in a reciprocating manner along the y-axis relative to the fuel injector 122, the sliding portion 126 of the fuel injector 122 slides back and forth within the passage 120. In a typical implementation, this relative sliding motion between the sliding portion 126 of the fuel injector 122 and the passage 120 results in the fuel injection nozzle 128 at the far end of the fuel injector's sliding portion moving into and out of the combustion chamber 118.

The fuel injector 122 is arranged to inject fuel into the combustion chamber 118 at appropriate times during engine operations to support fuel combustion inside the combustion chamber 118.

An air intake/pre-compression chamber 130 is located inside the engine casing 102 below the low pressure piston 104. The air intake/pre-compression chamber 130 is bounded by a bottom surface 132 of the low pressure piston 104, by a flared cylindrical wall 134 that extends downward from the bottom surface 132 of the low pressure piston 104 and by an inner surface 136 of the intake cylinder head 103.

A pair of annular grooves 138 is formed in an outer surface of the flared cylindrical wall 134 near a far end thereof. In a typical implementation, each groove 138 accommodates a piston ring (not shown). As the low pressure piston 104 moves up and down relative to the engine casing 102, the piston rings slide against (or near) the inner surface 136 of the intake cylinder head 103. The piston rings help reduce undesirable leakage of air out of the air-intake/pre-compression chamber 130 when the engine is operating.

Air intake valves 140 are provided to control air flow into the air intake/pre-compression chamber 130. The air-intake valves 140 can be spring-loaded, for example, and are generally operable to allow air to be drawn into the air intake/pre-compression chamber 130 at appropriate times during engine operation. In the illustrated embodiment, the air intake valves 140 are coupled to and supported by the intake cylinder head 103.

One or more combustion chamber air-intake valves (not shown in FIG. 1) are located between the air intake/pre-compression chamber 130 and the engine's combustion chamber 118. The combustion chamber air-intake valves are generally operable to enable air to flow at appropriate times during engine operation from the air-intake/pre-compression chamber 130 into the engine's combustion chamber 118.

An exhaust chamber 142 is located inside the engine casing 102 above the low pressure piston 104. Similar to the air-intake/pre-compression chamber 140, the exhaust chamber 142 is bounded by an upper surface 144 of the low pressure piston 104, by a flared cylindrical wall 146 that extends upward from the upper surface 144 of the low pressure piston 104 and by an inner surface 148 of the exhaust cylinder head 105.

As with the air-intake/pre-compression chamber 130, a pair of annular grooves 150 is formed in an outer surface of the flared cylindrical wall 146 near a far end thereof. In a typical implementation, each groove 138 is sized to accommodate a piston ring (not shown). As the low pressure piston 104 moves up and down relative to the engine casing 102, the piston rings slide against (or near) the inner surface 148 of the exhaust cylinder head 105. The piston rings help reduce undesirable leakage of exhaust gases out of the exhaust chamber 142 when the engine is operating.

The contact (or close fit) between the piston rings and the inner surface 136 of the intake cylinder head 103 and the contact (or close fit) between the piston rings and the inner surface 148 of the exhaust cylinder head 105 help index (or regulate) the low pressure piston's orientation as it moves up and down inside the engine casing 102.

One or more combustion chamber exhaust valves (not shown in FIG. 1) are located between the engine's combustion chamber 118 and the exhaust chamber 142. The combustion chamber exhaust valves are generally operable to enable exhaust gases to flow out of the combustion chamber 118 and into the exhaust chamber 142 at appropriate times during engine operations.

Engine exhaust valves 152 are provided to control the flow of exhaust gases out of the exhaust chamber 142. The engine exhaust valves 152 can be spring-loaded, for example, and are generally operable to allow exhaust gases to exit the exhaust chamber 142 at appropriate times during engine operations. In the illustrated embodiment, the engine's exhaust valves 152 are coupled to and supported by the exhaust cylinder head 105.

FIGS. 2A-2F are cross-sectional side views of an engine 200 at various points during the engine's operations.

In these figures, a low pressure piston 204 is shown moving up and down in a reciprocating manner relative to an engine casing 202. Moreover, high pressure pistons 212*a*, 212*b* are shown moving toward one another and away from one another in a reciprocating manner inside the low pressure piston 204.

A fuel injector 222 is secured to the intake cylinder head 103, which is secured to the engine casing 202, so that as the low pressure piston 204 moves up and down, a sliding portion 226 of the fuel injector 222 slides through a passage 228 in the low pressure piston 204. Accordingly, in the illustrated implementation, the fuel injection nozzle 228 at the upper far end of the fuel injector 222 moves in and out of the engine's combustion chamber 218.

Figure 2A:
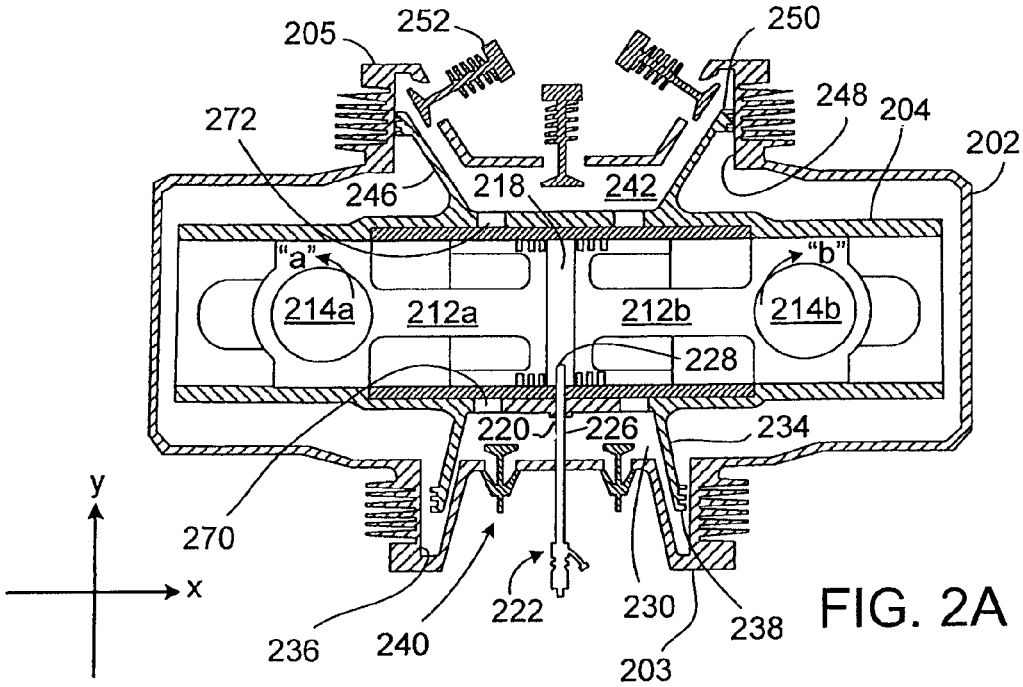
FIGS. 2A-2F are cross-sectional side views of an engine at various points during the engine's operations.

In FIG. 2A, the low pressure piston 204 is shown approximately mid-stroke and moving upward. With the low pressure piston at this position, the fuel injection nozzle 228 at the far end of the fuel injector's sliding portion 226 extends into the combustion chamber 218 a short distance. The high pressure pistons 212*a* and 212*b* are located at approximately top dead center. In a typical implementation, the fuel injector 222 injects fuel into the combustion chamber 218 with the low pressure piston 204 and the high pressure pistons 212*a*, 212*b* positioned substantially as shown.

The injected fuel ignites inside the combustion chamber 218. The ignition of fuel is substantially contained within the combustion chamber 218. The resulting explosion and expansion of combustion gases inside the combustion chamber 218 pushes the high pressure pistons 212*a*, 212*b* apart from one another. As the high pressure pistons 212*a*, 212*b* separate, crankshaft 214*a* rotates in one direction (indicated by arrow "a") and crankshaft 214*b* rotates in an opposite direction (indicated by arrow "b"). As the high pressure pistons 212*a*, 212*b* move apart from one another, the low pressure piston 204 moves in an upward direction relative to the engine casing 202.

In FIG. 2A, the engine's air-intake valves 240 are in an open position. In a typical implementation, the air-intake valves 240 remain in an open position for substantially the entire time that the low pressure piston 204 is moving upward inside the engine casing 202. This allows air to flow into the engine through the engine's air-intake valves 240 while the low pressure piston 204 is moving upward.

In FIG. 2A, the combustion chamber air-intake valves 270 and combustion chamber exhaust valves 272 are in a closed position. This helps prevent the combustion gases that are expanding inside the combustion chamber 218 from escaping into either the air-intake/pre-compression chamber 230 or the exhaust chamber 242.

As the low pressure piston 204 moves upward inside the engine casing 202, piston rings, which are contained in grooves 238 in the outer surface of flared cylindrical wall 234, remain in contact with or at least very close to the inner surface 236 of the intake cylinder head 103. This substantially seals the air-intake/pre-compression chamber 230 from other areas around the low pressure piston 204 inside the engine casing 202. As such, the low pressure piston's upward motion tends to create a low pressure environment within the air-intake/pre-compression chamber 230. This helps draw air into the air-intake/pre-compression chamber 230 from the engine's ambient environment.

In FIG. 2A, the engine's exhaust chamber 242 contains exhausted combustion gases from an earlier combustion event that occurred in the combustion chamber 218. The engine's 200 exhaust valves 252 are in an open position and thereby enable the combustion gases inside the exhaust chamber 242 to exit the engine 100. In a typical implementation, the exhaust valves 252 remain in an open position for at least part of the time that the low pressure piston 204 is moving upward inside the engine casing 202.

As the low pressure piston 204 moves upward inside the engine casing 202, the piston rings, contained in the grooves 250 formed in the outer surface of the of the flared cylindrical wall 246, remain in contact with or at least very close to the inner surface 248 of the exhaust cylinder head 105. This substantially seals the engine's exhaust chamber 242 from other areas of the engine inside the engine casing 202. The low pressure piston's upward motion when the engine's exhaust valves 252 are open helps push combustion gases out of the engine 200.

Figure 2B:
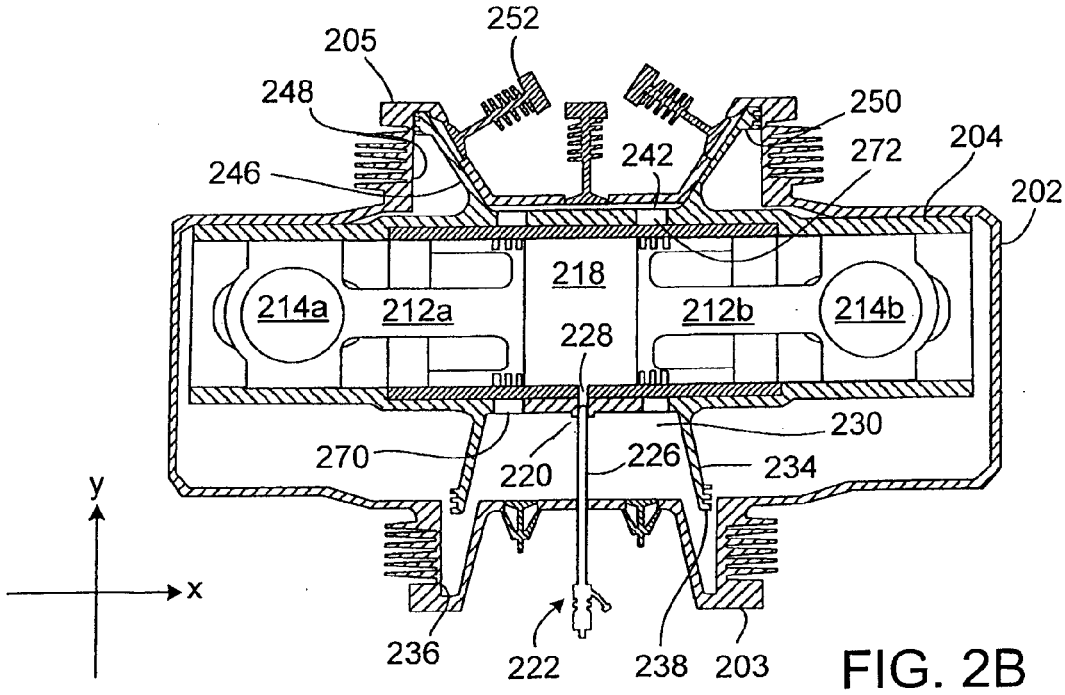

FIG. 2B shows the low pressure piston 204 at the upper end of its stroke inside the engine casing 202. With the low pressure piston 204 in this position, the high pressure pistons 212*a*, 212*b* have traveled about halfway between top dead center (FIG. 2A) and bottom dead center (FIG. 2D). Between FIG. 2A and FIG. 2B, the crankshafts 214*a*, 214*b* have rotated about their respective axes approximately 90 degrees.

In FIG. 2B, the engine's intake valves 240 and exhaust valves 252 are in a closed position. In some embodiments, the engine's intake and exhaust valves 240, 252 close at about the same time that the low pressure piston 204 reaches the end of its stroke closest to the exhaust valves 252.

Moreover, in FIG. 2B, the combustion chamber's air-intake 270 and exhaust 272 valves are closed. This helps keep the combustion gases, which are expanding inside the combustion chamber 218 contained therein.

As the low pressure piston 204 moves between its position shown in FIG. 2A and its position shown in FIG. 2B, the sliding portion 226 of the fuel injector 222, which remains stationary relative to the engine casing 202, slides inside the passage 228. In FIG. 2B, the low pressure piston 204 is positioned relative to the fuel injector 222 so that only a small far portion of the fuel injector's sliding portion 226 passes into the passage 228. The fuel injection nozzle 228 at the upper far end of the fuel injector 222 is substantially outside of chamber 218.

In a typical implementation, with the low pressure piston 204 positioned as shown in FIG. 2B, a seal is maintained around the sliding portion 226 of the fuel injector 222 to prevent or substantially minimize leakage of combustion gases through the passage 228.

Due at least in part to the momentum of the engine's components and to the continuing expansion of combustion gases inside the combustion chamber 218, the high pressure pistons 212*a*, 212*b* in FIG. 2B continue to move apart and the crankshafts 214*a*, 214*b* continue to rotate. Moreover, from its position shown in FIG. 2B, the low pressure piston continues moving downward inside the engine casing 202.

Figure 2C:
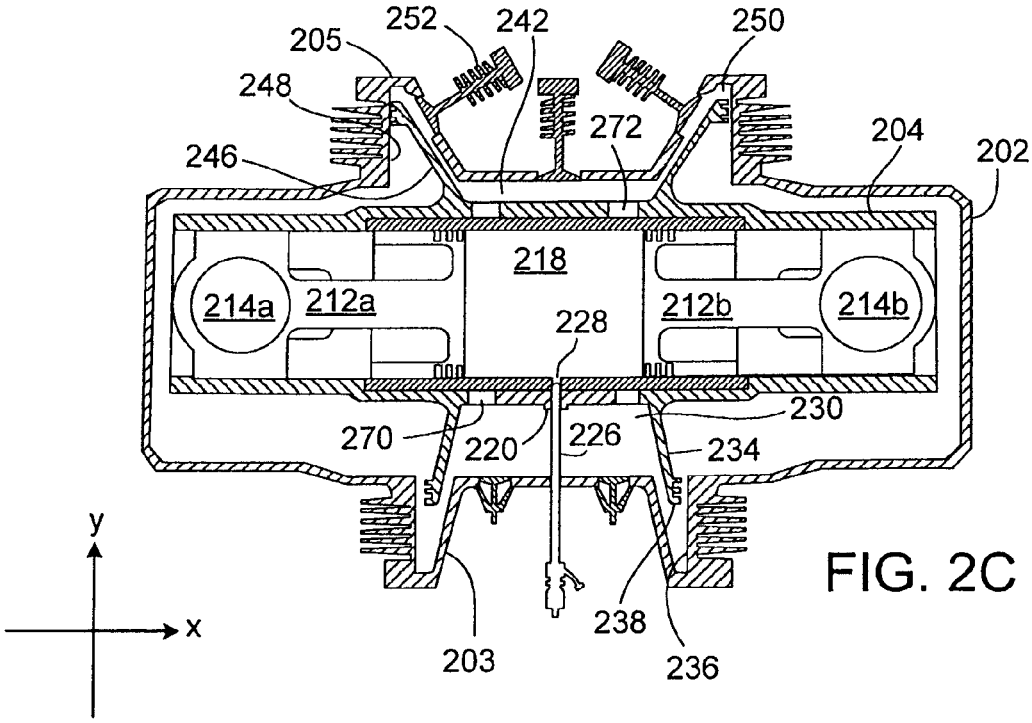
Figure 2D:
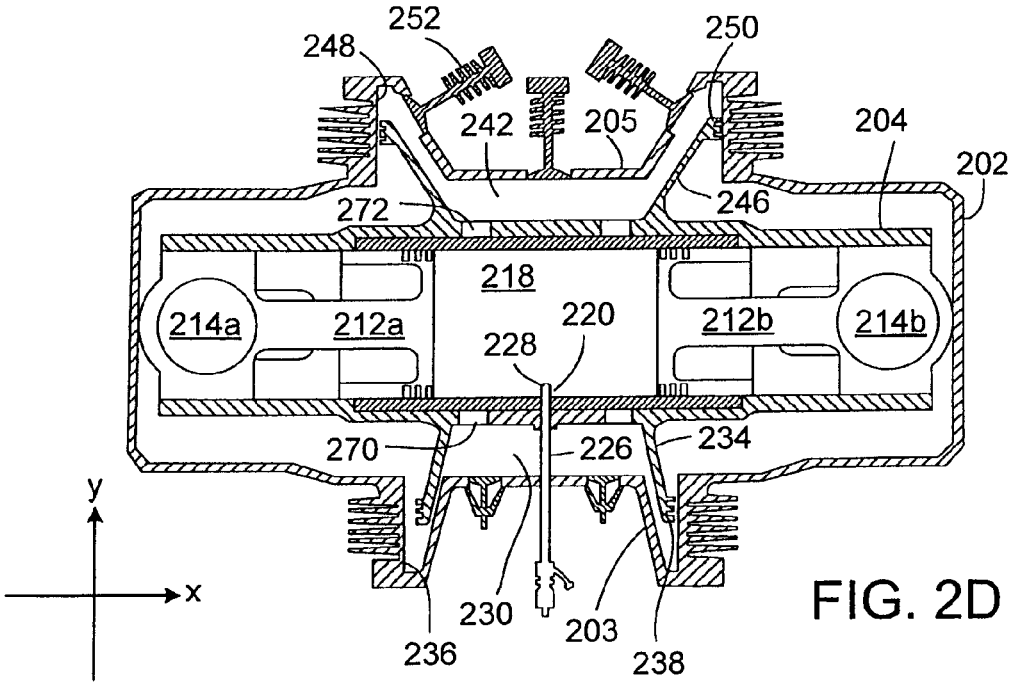

FIG. 2C shows the engine components in a configuration that corresponds to the crankshafts 214*a*, 214*b* being displaced approximately 135 degrees from their positions shown in FIG. 2A when the high pressure pistons 212*a*, 212*b* were at top dead center.

In the illustrated configuration, the combustion gases inside the combustion chamber 218 are continuing to expand and the high pressure pistons 212*a*, 212*b* are continuing to move apart. The low pressure piston 204 is continuing to move downward.

The engine's air-intake valves 240 and the combustion chamber's air-intake valves 270 are in a closed position. Accordingly, the downward motion of the low pressure piston 204 is compressing the air inside the air-intake/pre-compression chamber 230.

The engine's exhaust valves 252 are in a closed position as well. The combustion chamber's exhaust valves 272 are open, which enables the combustion gases to flow from the combustion chamber 218 to the exhaust chamber 242. Typically, the combustion gases still are expanding as this occurs. The continued expansion of combustion gases into the exhaust chamber 242, in some implementations, helps urge the low pressure piston 204 to move downward inside the engine casing 202. In some implementations, this enhances the engine's efficiency. Moreover, since the engine's exhaust valves 252 are closed, the downward motion of the low pressure piston 204 creates a low pressure environment inside the exhaust chamber 252 that helps draw the combustion gases out of the combustion chamber 218.

In FIG. 2C, the sliding portion 226 of the fuel injector 222, which is stationary relative to the engine casing 202, is sliding through passage 220 toward the combustion chamber 218.

FIG. 2D shows the engine components in a configuration that corresponds to the crankshafts 214*a*, 214*b* being displaced approximately 180 degrees from their positions shown in FIG. 2A when the high pressure pistons 212*a*, 212*b* were at top dead center. Accordingly, the high pressure pistons 212*a*, 212*b* in FIG. 2D are at bottom dead center.

The low pressure piston is continuing to move in a downward direction. In some implementations, at the point in the cycle shown in FIG. 2D, the combustion gases are continuing to expand in the exhaust chamber 242, which contributes to pushing the low pressure piston down in the engine casing 202.

The engine's air-intake valves 240 and the combustion chamber's air-intake valves 270 are in a closed position and so, the downward motion of the low pressure piston 204 continues to compress the air inside the air-intake/pre-compression chamber 230.

The engine's exhaust valves 252 are in a closed position as well. The combustion chamber's exhaust valves 272 are open, which enables the combustion gases to continue to flow out from the combustion chamber 218 into the exhaust chamber 242.

In FIG. 2C, the sliding portion 226 of the fuel injector 222, which is stationary relative to the engine casing 202, continues sliding through passage 228 into the combustion chamber 218.

Figure 2E:
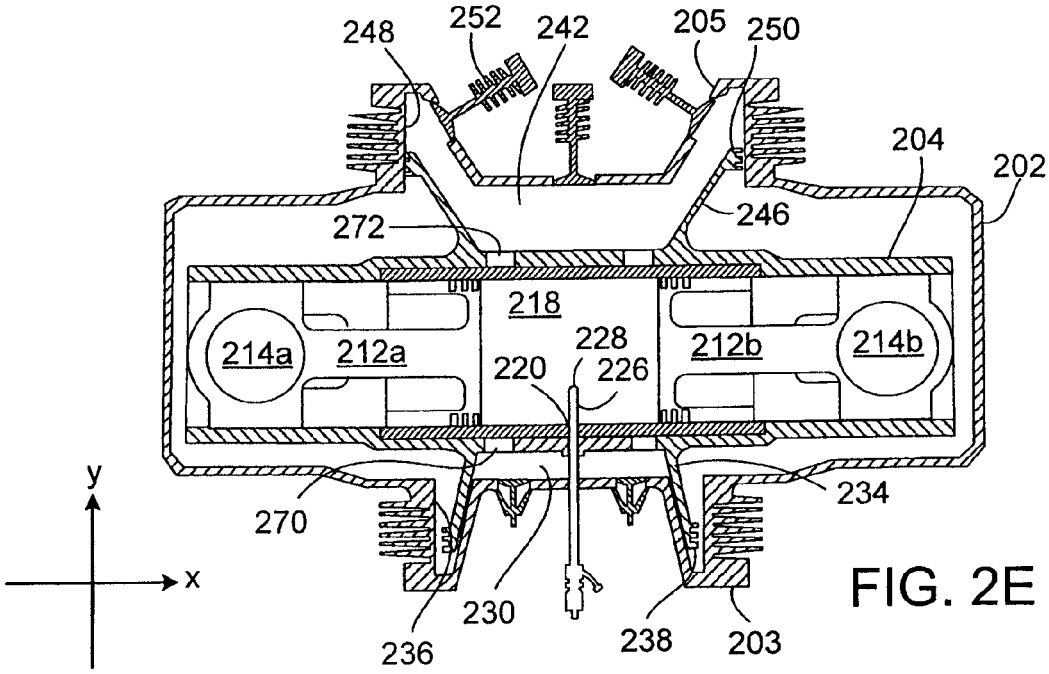

FIG. 2E shows the engine components in a configuration that corresponds to the crankshafts 214*a*, 214*b* being displaced approximately 225 degrees from their positions shown in FIG. 2A when the high pressure pistons 212*a*, 212*b* were at top dead center.

The low pressure piston is continuing to move in a downward direction. The engine's air-intake valves 240 and exhaust valves 252 are in a closed position.

The combustion chamber's air-intake valves 270 open thereby enabling the compressed air inside the air-intake/pre-compression chamber 230 to flow into the combustion chamber. The pressure of the compressed air, as well as the continuing downward motion of the low pressure piston 204 typically results in a large amount of air being pushed into the combustion chamber 218.

At some point either shortly before, shortly after or at substantially the same time that the combustion chamber's air-intake valves 270 open, the combustion chamber's exhaust valves 272 close. The combustion chamber's exhaust valves are operable to allow some, but typically not all of the combustion gases to exit the combustion chamber.

Figure 2F:
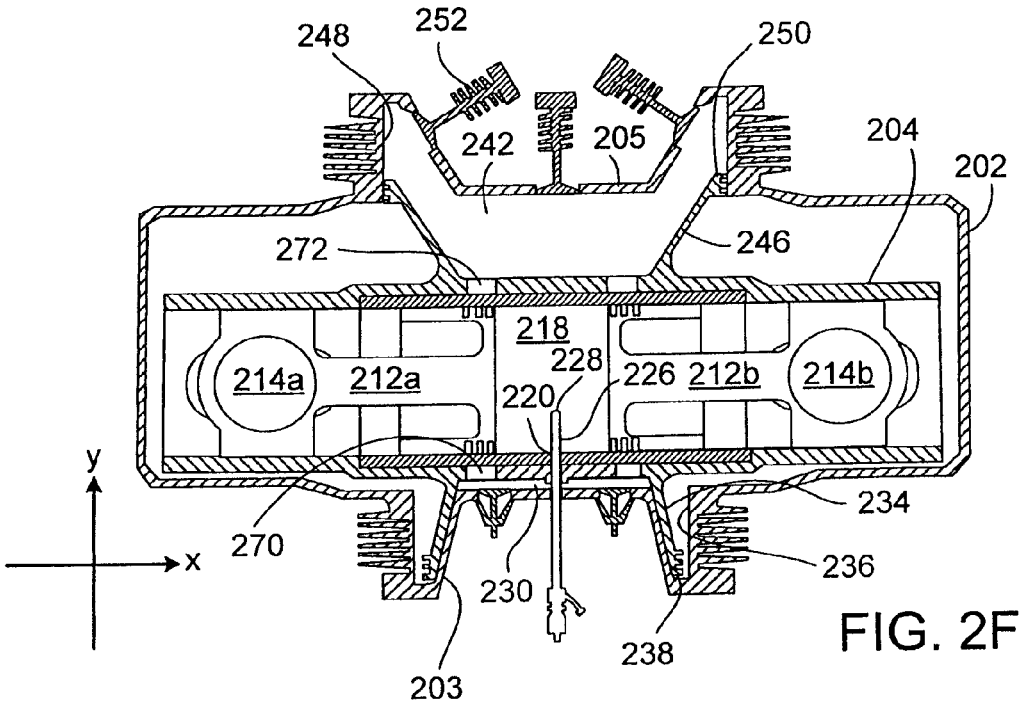

In a typical implementation, once open, the combustion chamber's air-intake valves remain open until the low pressure piston reaches about the lower end of its stroke (as shown in FIG. 2F). Typically, air continues to be pushed into the combustion chamber 218 as long as the combustion chamber's air-intake valves 270 are open and the low pressure piston 204 is moving in a downward direction.

In FIG. 2E, the engine's high pressure pistons 212*a*, 212*b* are moving toward one another. In a typical implementation, with the engine components configured as shown in FIG. 2E, the space between the two high pressure pistons 212*a*, 212*b* and the air-intake/pre-compression chamber 230 that has a volume that is decreasing. As the volume decreases, the air moving from the air-intake/pre-compression chamber 230 into the combustion chamber 218 is further compressed.

Moreover, in FIG. 2E, the sliding portion 226 of the fuel injector 222, continues sliding through passage 228 deeper into the combustion chamber 218. The engine's exhaust valves 252 and the combustion chamber's exhaust valves 272 are in a closed position.

FIG. 2F shows the engine components in a configuration that corresponds to the crankshafts 214*a*, 214*b* being displaced approximately 270 degrees from their positions shown in FIG. 2A when the high pressure pistons 212*a*, 212*b* were at top dead center. The low pressure piston 204 is at the lowest point in its stroke. The high pressure pistons 212*a*, 212*b* are moving toward one another and are about midway between bottom dead center (FIG. 2D) and top dead center (FIG. 2A). As shown, the sliding portion 226 of the fuel injector 222 is extended into the combustion chamber 218 as deep as it will be.

In FIG. 2F, substantially all of the air from the air-intake/pre-compression chamber 230 has been transferred into the combustion chamber 218. The combustion chamber air-intake valves 270 and exhaust valves 272 are in a closed position. The continued movement of the high pressure pistons 212*a*, 212*b* toward one another from their respective positions shown in FIG. 2F further compresses the air inside the combustion chamber 218.

The engine's air-intake valves 240 are in a closed position. The engine's exhaust valves 252 are in a closed position. In a typical implementation, with the engine components configured as shown, the combustion gases have substantially finished expanding.

Typically, the engine's air-intake valves 240 and the engine's exhaust valves 252 move to an open position when or very shortly after the low pressure piston 204 begins moving upward direction from its position shown in FIG. 2F.

FIGS. 3A-3D are cross-sectional schematic views showing a view of the fuel injector 222 and low pressure piston 204 of FIGS. 2A-2F.

As illustrated, the low pressure piston 204 includes surfaces that define a nipple 380 that extends in an outward, radial direction from the otherwise cylindrical outer surface of the low pressure piston 204. The nipple 380 has surfaces that define the passage 228 into the combustion chamber 218.

Figures 3A, 3B, 3C, 3D:
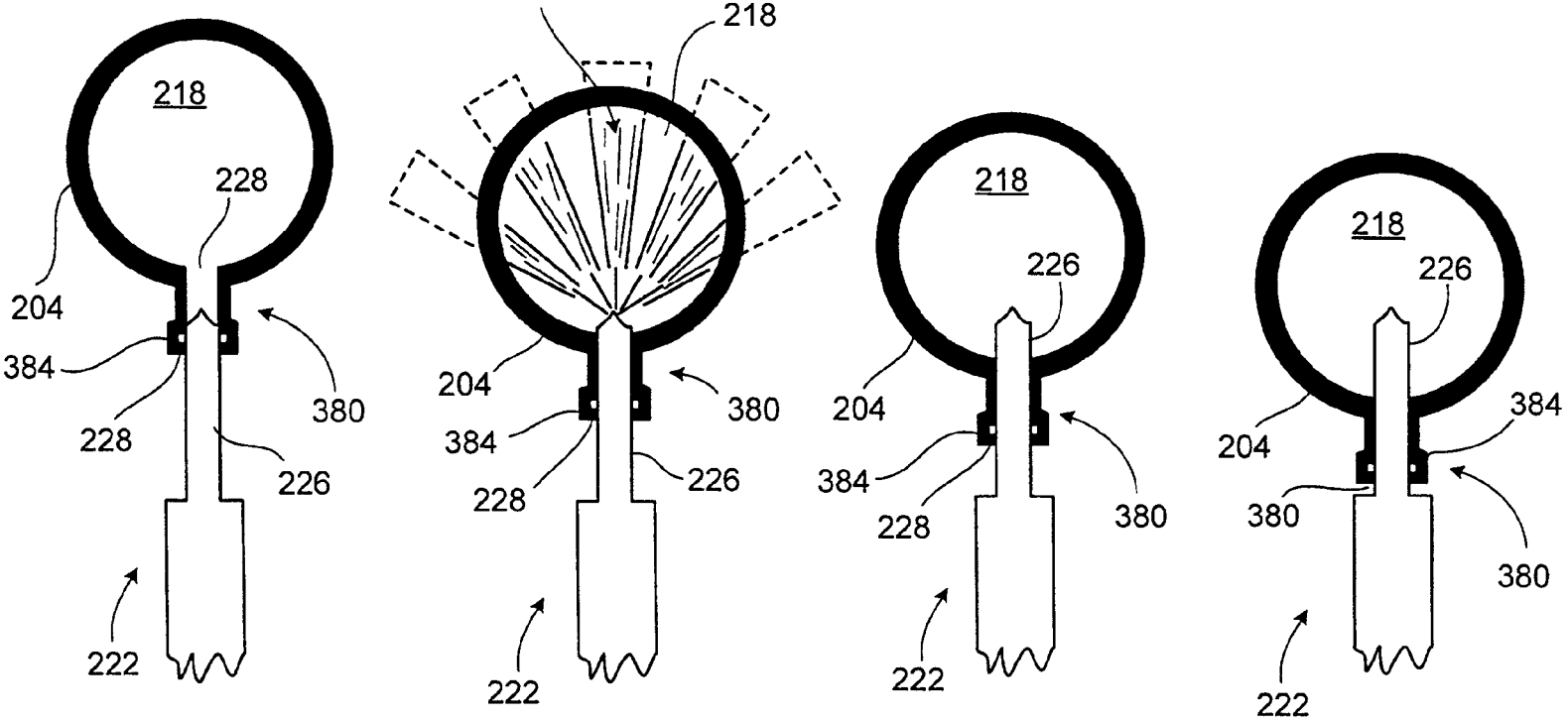
FIGS. 3A-3D show a progression of cross-sectional schematic views of the fuel injector of FIGS. 2A-2F moving into and out of and the combustion chamber.

The sliding portion 226 of the fuel injector 222 extends, in all of FIGS. 3A-3D, at least partially through the passage 228. The relative motion between the low pressure piston 204 and the fuel injector 222 results in the sliding portion 226 sliding inside the passage from a first position substantially withdrawn from the combustion chamber 218 into passage 228 (FIG. 3A) to a second position of maximum extension into the combustion chamber 218 (FIG. 3D).

The fuel injector 222, in a typical implementation, is operable to inject fuel when the fuel injection nozzle at the far tip of the fuel injector 222 is extended into the combustion chamber 218 a small distance. This is represented in FIG. 3B, which shows a number of conical patterns 382 that extend from the far tip of the fuel injector 222, which collectively represent a fuel spray pattern from the injector 222.

In the illustrated implementation, the nipple 380 has surfaces that define an annular recess 384 near a far end of the nipple 380. In some implementations, the annular recess 384 is sized and shaped to accommodate an annular sealing member. The annular sealing member can be implemented in a number of possible ways.

One option, but not the only option, for the annular sealing member is to use a floating, gapless graphite ring with a slight interference fit on the sliding portion 226 of the fuel injector 222. In such an implementation, the ring is captured in the annular recess. The bore of the passage 228 generally allows sufficient clearance around the sliding portion 226 of the fuel injector 222 to avoid binding. The ring, in these implementations, floats in the annular recess and seats against a substantially flat outer surface of the annular groove against a pressure differential as it develops.

In some implementations, the annular sealing ring has an inner bore that is tapered toward the combustion chamber 218. In some implementations, the annular sealing ring has an inner bore with a chevron-shaped cross-section. In such instances, for example, a flexure or lip of the chevron may be in contact with the sliding portion 226 of the fuel injector 222.

In some implementations, the sliding portion of the fuel injector 222 is coated with a durability enhancing coating that includes, for example, molybdenum.

A number of embodiments of the invention have been described. Nevertheless, it will be understood that various modifications may be made without departing from the spirit and scope of the invention.

For example, the specific arrangement and configuration of various engine components can vary. Indeed, in some implementations, certain components may be dispensed with entirely. For example, some implementations can include only one (i.e., not two) high pressure piston arranged for reciprocal motion inside a low pressure piston.

Moreover, the relative arrangement and direction of movement that the various components experience during engine operation can vary as well. So, for example, in some implementations, rather than moving up and down, the low pressure piston may be adapted to move left to right. In such instances, the high pressure pistons may be adapted to move up and down inside the low pressure piston.

The various components disclosed can have a variety of shapes and sizes. The timing of various events during engine operations can vary as well.

The techniques, components and systems disclosed herein can be adapted for use in connection with a variety of different engine styles including, for example, engines that run on diesel fuel or other heavy fuels, engines that run on gasoline or alcohols and engines with or without spark ignition.

Engines implementing the techniques disclosed herein can be used in connection with a wide variety of applications including, for example, aircraft auxiliary power units, alternative light vehicle engines, marine engines, on-highway truck engines, military unmanned aerial vehicles, tactical vehicle engines and aircraft engines.

Moreover, an engine can include several of the arrangements illustrated in FIG. 1, for example, in a stacked configuration. In such an embodiment, the resulting engine would include a pair of crankshafts and the high pressure pistons of each unit in the stack would be coupled to an associated one of the two crankshafts.

Other implementations are within the scope of the claims.

What is claimed is:

1. An engine comprising:

a first piston with surfaces that define a substantially cylindrical chamber inside the first piston and a passage into the substantially cylindrical chamber;

one or more second pistons arranged to reciprocate inside the substantially cylindrical chamber and to define, in cooperation with the substantially cylindrical chamber, a combustion chamber; and a fuel injector that extends at least partially through the passage in the first piston to inject fuel into the combustion chamber;

wherein the first piston is arranged to move in a reciprocating manner relative to the fuel injector.

2. The engine of claim 1 wherein the fuel injector is arranged to reciprocate inside the passage relative to the first piston as the first piston moves in the reciprocating manner.

3. The engine of claim 1 further comprising:

an engine casing, wherein the fuel injector is stationary relative to the engine casing.

4. The engine of claim 3 wherein:

the first piston is arranged to reciprocate along a first axis relative to the engine casing; and the one or more second pistons are arranged to reciprocate along a second axis relative to the first piston, wherein the second axis is perpendicular to the first axis.

5. The engine of claim 1 wherein the first piston comprises a nipple with surfaces that at least partially define the passage into the substantially cylindrical chamber.

6. The engine of claim 5 wherein the nipple has surfaces that define an annular recess to accommodate an annular sealing member.

7. The engine of claim 6 wherein the annular recess is near a far end of the nipple.

8. The engine of claim 6 further comprising:

an annular sealing member arranged at least partially inside the annular recess to seal the combustion chamber.

9. The engine of claim 8 wherein the annular sealing member has an internal bore with a cross-sectional profile that is tapered toward the combustion chamber.

10. The engine of claim 8 wherein the annular sealing member has an internal bore with a chevron-shaped cross-sectional profile.

11. The engine of claim 8 wherein the annular sealing member forms a slight interference fit against a sealing portion of the fuel injector.

12. The engine of claim 11 wherein the sealing portion of the fuel injector is coated with an agent to enhance the seal's durability.

13. The engine of claim 12 wherein the agent comprises molybdenum.

14. The engine of claim 1 wherein the fuel injector is arranged to inject fuel into the combustion chamber when the fuel injector is approximately mid-stroke between a position of maximum extension into the combustion chamber and a position of maximum withdrawal from the combustion chamber.

15. The engine of claim 1 comprising:

two second pistons arranged opposing each other inside the substantially cylindrical chamber, wherein the combustion chamber comprises a space between the two opposing second pistons.

16. The engine of claim 1 wherein the first piston further comprises:

one or more combustion chamber intake valves at a first side of the first piston; and one or more combustion chamber exhaust valves at a second side of the first piston, opposite the first side, wherein the fuel injector is arranged to inject fuel into the combustion chamber from the first side of the first piston.

17. The engine of claim 1 implemented as a compact compression ignition engine.

18. The engine of claim 1 further comprising:

an annular sealing member arranged to seal the combustion chamber around a portion of the fuel injector.

19. The engine of claim 1 wherein a distal end of the fuel injector, which remains stationary relative to the engine casing as the first piston reciprocates relative to the engine casing, is configured so as to extend deeper into and less deep into the combustion chamber as the first piston moves in the reciprocating manner relative to the fuel injector.

20. The engine of claim 19 wherein a surface that defines the passage in the first piston moves back and forth along a portion of the fuel injector that extends at least partially through the passage while the first piston moves toward and away from the fuel injector.

21. The engine of claim 1 wherein the first piston is configured to move in a reciprocating manner relative to a distal tip of the fuel injector, wherein fuel flows out of the distal tip and into the combustion chamber.

22. A compact compression ignition engine comprising:

an engine casing;

a first piston inside the engine casing with surfaces that define a substantially cylindrical chamber inside the first piston and a passage into the substantially cylindrical chamber;

opposing second pistons arranged to reciprocate inside the substantially cylindrical chamber and to define, in cooperation with the substantially cylindrical chamber, a combustion chamber between the opposing second pistons; and a fuel injector stationary relative to the engine casing and extended at least partially through the passage in the first piston to inject fuel into the combustion chamber;

wherein the first piston is arranged to move in a reciprocating manner relative to engine casing and the fuel injector.

23. The engine of claim 22 wherein:

the first piston is arranged to reciprocate along a first axis relative to the engine casing; and the second pistons are arranged to reciprocate along a second axis relative to the first piston, wherein the second axis is perpendicular to the first axis.

24. The engine of claim 22 wherein the first piston comprises a nipple with surfaces that at least partially define the passage into the substantially cylindrical chamber, wherein the nipple has surfaces that define an annular recess near a far end of the nipple to accommodate an annular sealing member, wherein the annular recess is near a far end of the nipple, and an annular sealing member arranged at least partially inside the annular recess and adapted to seal the combustion chamber.

25. The engine of claim 22 wherein a distal end of the fuel injector, which remains stationary relative to the engine casing as the first piston reciprocates relative to the engine casing, is configured so as to extend deeper into and less deep into the combustion chamber as the first piston moves in the reciprocating manner relative to the fuel injector.

26. The engine of claim 25 wherein one of the surfaces, which defines the passage into the substantially cylindrical chamber, is configured to move back and forth along a portion of the fuel injector that is extended at least partially through the passage, as the first piston moves in the reciprocating manner relative to the fuel injector.

27. The engine of claim 22 wherein the first piston is configured to move in a reciprocating manner relative to a distal tip of the fuel injector, wherein fuel flows out of the distal tip and into the combustion chamber.

* * * * *